US009322617B2

(12) United States Patent
Hartley et al.

(10) Patent No.: US 9,322,617 B2
(45) Date of Patent: Apr. 26, 2016

(54) LASER SIGHT FOR ROCKET LAUNCHER

(71) Applicant: Crimson Trace Corporation, Wilsonville, OR (US)

(72) Inventors: Scott Hartley, Wilsonville, OR (US); James McDonald, Wilsonville, OR (US); Dale Suzuki, Wilsonville, OR (US); Dee Swartz, Wilsonville, OR (US); Jason Kleiber, Wilsonville, OR (US)

(73) Assignee: Crimson Trace Corporation, Wilsonville, OR (US)

( * ) Notice: Subject to any disclaimer, the term of this patent is extended or adjusted under 35 U.S.C. 154(b) by 416 days.

(21) Appl. No.: 13/801,992

(22) Filed: Mar. 13, 2013

(65) Prior Publication Data

US 2015/0241170 A1 Aug. 27, 2015

Related U.S. Application Data

(60) Provisional application No. 61/610,448, filed on Mar. 13, 2012.

(51) Int. Cl.
*F41G 11/00* (2006.01)
*F41G 1/36* (2006.01)
(Continued)

(52) U.S. Cl.
CPC .. *F41G 1/36* (2013.01); *F41G 1/35* (2013.01); *F41G 1/473* (2013.01); *F41G 11/001* (2013.01); *F41G 11/003* (2013.01);
(Continued)

(58) Field of Classification Search
CPC ..... F41G 1/36; F41G 7/008; F41G 1/35; F41G 1/473; F41G 11/001; F41G 11/006; F41G 11/007; F41F 3/045; F41F 3/04
USPC ..... 42/114; 89/1.8
See application file for complete search history.

(56) References Cited

U.S. PATENT DOCUMENTS 3,990,355 A * 11/1976 Looger ..... F41G 11/00 42/148
4,742,636 A * 5/1988 Swan ..... F41G 11/006 42/126

(Continued)

OTHER PUBLICATIONS

International Search Report and Written Opinion for International Application No. PCT/US2013/031043, mailed Dec. 17, 2013.

*Primary Examiner* — Joshua Freeman
*Assistant Examiner* — Bridget Cochran
(74) *Attorney, Agent, or Firm* — Schwabe, Williamson & Wyatt, P.C.

(57) ABSTRACT

Embodiments herein relate to the field of firearm accessories, and, more specifically, to reusable laser sighting devices for rocket launchers and other large weapons, particularly reusable laser sighting devices that allow retrofitting of existing weapons inventory. Some embodiments include a base plate that is configured to be permanently coupled to a rocket launcher, such as the M72 LAW, and a laser module configured to removably couple to the base plate. In various embodiments, the systems disclosed herein permit a the module to be removed from the base plate of a spent rocket launcher, and coupled to the base plate of a new rocket launcher, thereby reducing waste. In various embodiments, the laser module may be factory calibrated with respect to the base plate, and therefore once the base plate has been fixed to the rocket launcher, no field calibrations of the laser module are necessary.

16 Claims, 6 Drawing Sheets

(51) Int. Cl.
*F41G 1/35* (2006.01)
*F41G 1/473* (2006.01)
*F41F 3/04* (2006.01)

(52) U.S. Cl.
CPC ..... *F41G 11/006* (2013.01); *F41G 11/007* (2013.01); *F41F 3/04* (2013.01)

(56) References Cited

U.S. PATENT DOCUMENTS 4,934,085 A * 6/1990 Lough ..... F41G 11/003 42/124
6,295,754 B1 * 10/2001 Otteman ..... F41G 1/38 42/111
7,481,016 B2 * 1/2009 Gonzalez ..... F41C 23/16 42/124
7,694,450 B2 * 4/2010 Keng ..... F41G 11/003 42/124
8,047,118 B1 * 11/2011 Teetzel ..... F41G 1/473 235/414
8,100,044 B1 * 1/2012 Teetzel ..... F41G 1/473 235/414
8,297,173 B1 * 10/2012 Teetzel ..... F41G 3/165 42/111
8,763,299 B2 * 7/2014 Clifton ..... F41G 1/387 42/125
2005/0257415 A1 * 11/2005 Solinsky ..... F41G 11/003 42/146
2006/0104064 A1 * 5/2006 Sharrah ..... F21S 9/02 362/287
2010/0162611 A1 * 7/2010 Samson ..... F41G 1/18 42/125
2011/0154713 A1 * 6/2011 Jung ..... F41G 1/30 42/137
2011/0296732 A1 * 12/2011 Carlson ..... F41G 11/008 42/90
2012/0180367 A1 * 7/2012 Singh ..... F41G 1/473 42/117

* cited by examiner

LASER SIGHT FOR ROCKET LAUNCHER

CROSS REFERENCE TO RELATED APPLICATIONS

The present application claims priority to U.S. Patent Application No. 61/610,448, filed Mar. 13, 2012, entitled "LASER SIGHT FOR ROCKET LAUNCHER," the disclosure of which is hereby incorporated by reference in its entirety.

TECHNICAL FIELD

Embodiments herein relate to the field of firearm accessories, and, more specifically, to sighting devices for rocket launchers and other large weapons.

BACKGROUND

Rocket launchers include shoulder-launched missile weapons, which category encompasses any weapon that fires a rocket-propelled projectile at a target, yet is small enough to be carried by a single person and fired while held on one's shoulder. Specific types of rocket launchers within this group include the rocket-propelled grenade, better known as the RPG, which is a type of shoulder-launched anti-tank weapon; the anti-tank guided missile, a guided missile primarily designed to hit and destroy heavily-armored tanks and other armored fighting vehicles; and the man-portable air-defense systems, which provide shoulder-launched surface-to-air missiles. A smaller variation is the gyrojet, a small arm rocket launcher with ammunition slightly larger than that of a .45-caliber pistol. Generally speaking, rocket launchers fire projectiles that continue to propel themselves after leaving the barrel of the weapon. In some situations, it may be desirable to guide the aiming of a rocket launcher using a sight, such as a laser sighting device, however many rocket launchers only have traditional iron sights for daylight use.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1A:
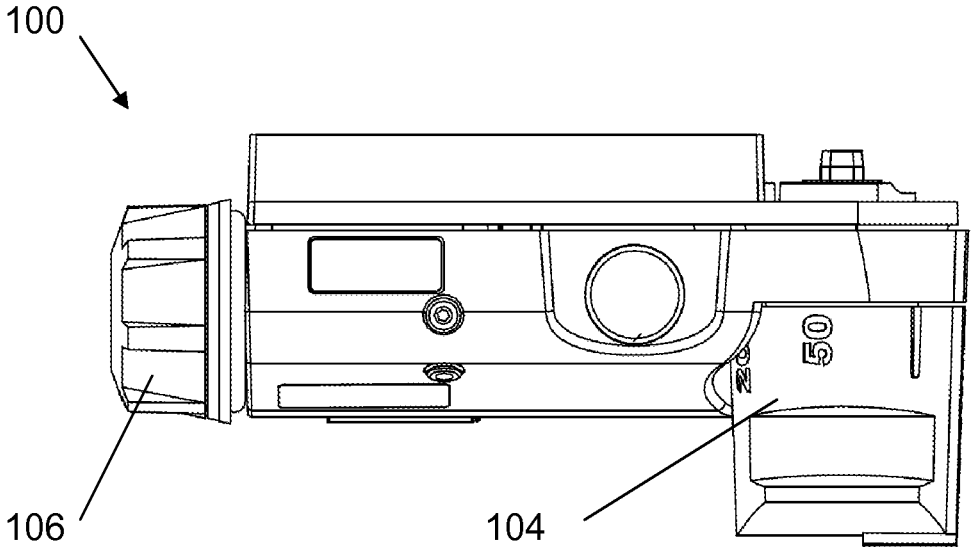
FIGS. 1A-1D are four views of a laser module for use in accordance with various embodiments, including a top view (FIG. 1A), a right side view (FIG. 1B), a front view (FIG. 1C), and a rear view (FIG. 1D)

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Embodiments herein provide laser sights for rocket launchers, such as the M72 shoulder fire weapon, and other weapons, such as rifles, long guns, and grenade launchers, such as the 203 and 320 grenade launchers. In various embodiments, the laser sight may include a fixed base plate permanently mounted to the rocket launcher, and a reusable laser module that may be coupled to and decoupled from the base plate. In various embodiments, windage and elevation calibrations are not necessary, even when the laser module is reused multiple times with different weapons.

Some embodiments of the laser sights disclosed herein may provide low light aiming lasers for use with rocket launchers, such as the family of M72 LAW Shoulder Fired Rocket Launchers manufactured by Nammo Tally. The M72 LAW incorporates a traditional sighting system referred to as an iron sight, which includes two alignment markers: one at the muzzle, and the other at the midpoint of the launcher. The muzzle sight is adjustable to compensate for target distance, and thus aiming the launcher requires first adjusting the muzzle sight to compensate for distance, and then visually aligning both alignment markers with the target in a single line of sight. Under daylight conditions, targeting typically is not difficult. However, under reduced ambient light conditions, targeting using an iron sight system may be extremely difficult.

The disclosed laser sights facilitate low light aiming, and some embodiments also add the benefit of instinctive targeting in low light conditions. In various embodiments, because the M72 LAW launcher tube is disposable, the laser sight may use a quick detach mounting mechanism to couple the laser module to a base plate that is fixed to the M72 LAW tube, thus allowing an operator to easily attach the laser module to the base plate before firing, and then remove the module from the base plate before disposing of the tube, all without having to adjust windage and/or elevation. In various embodiments, the laser sights disclosed herein may allow the retrofitting of existing inventories of rocket launchers and other weapons with laser sighting devices. In various embodiments, the disclosed laser modules also may be reused multiple times with a number of individual rocket launchers, conserving resources and reducing waste.

Furthermore, the range of the laser sights disclosed in some embodiments may be changed to suit the type of round being used. For example, in some embodiments, the range may be adjusted to a distance between 50 meters and 200 meters. Thus, in various embodiments, the quadrant and elevation values may be adjusted to suit the ballistic properties of a given munition. In some embodiments, the weight of the projectile and the propellant used may affect the quadrant and elevation values selected. For example, and A9 round may use different quadrant and elevation values than an A7 round. Thus, a single laser sighting module may be used (and reused) for a variety of different purposes in various embodiments.

Figure 1B:
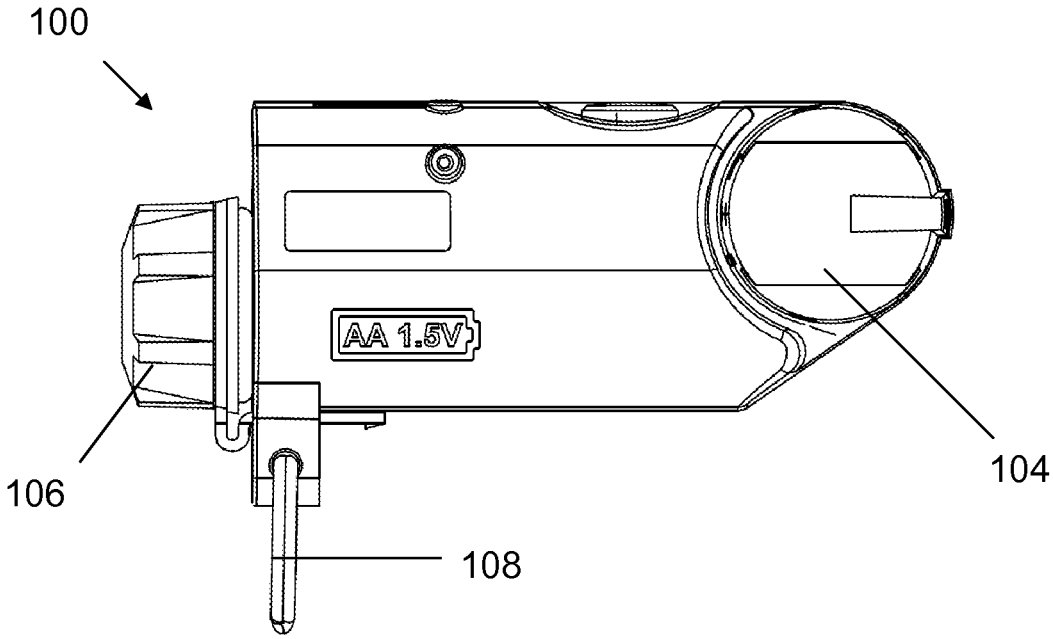
Figure 1C:
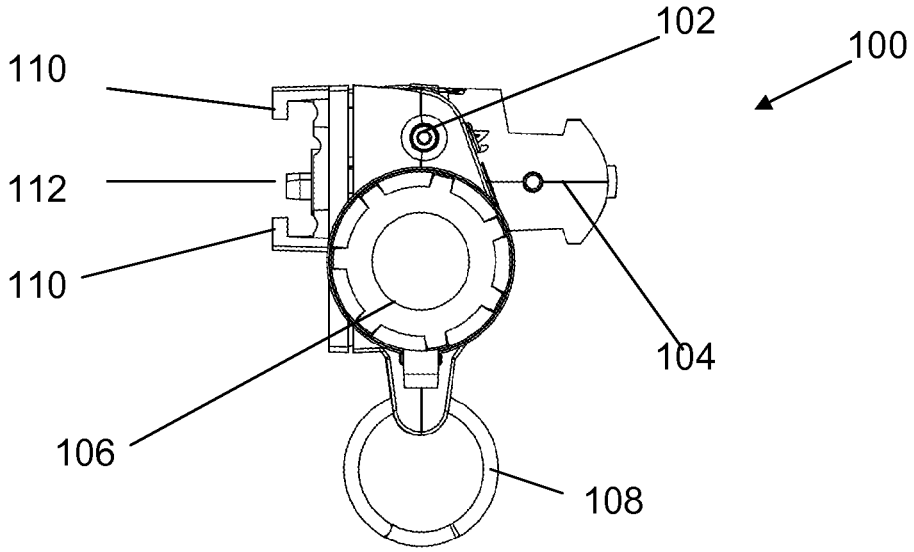
Figure 1D:
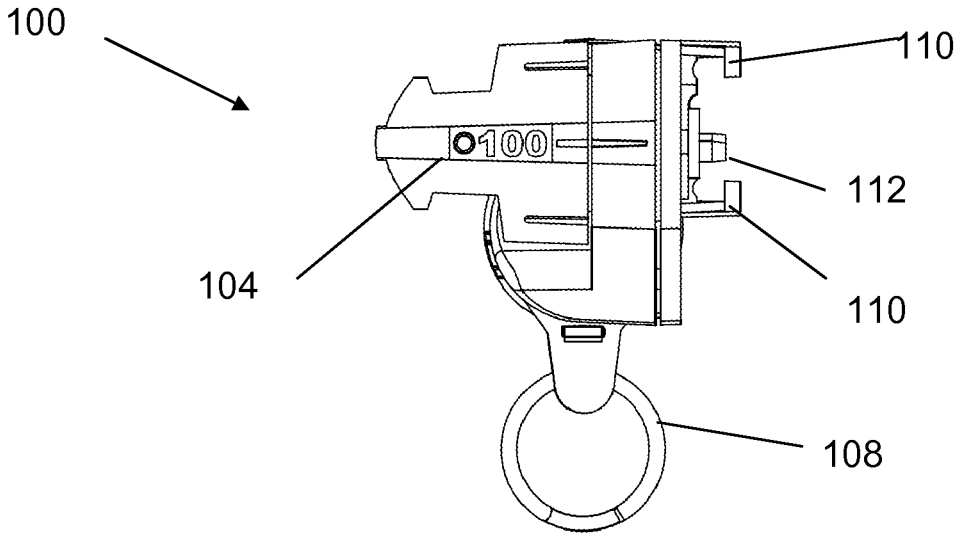

One specific, non-limiting example of a laser module for use in various embodiments is illustrated in FIGS. 1A-1D, which include a top view (FIG. 1A), a side view (FIG. 1B), a front view (FIG. 1C), and a rear view (FIG. 1D). In the illustrated embodiment, the laser module 100 may be adapted to removably couple to a base plate (not shown), and, as may be best seen in FIG. 1C, may be provided with a laser source 102 configured to emit a beam of light in the visible or infrared spectrum. For example, in various embodiments, a red, green, or infrared laser diode may be provided, such as a diode configured to emit in the 635 nm range (visible) or in the 850 nm range (infrared). Although the illustrated embodiment includes only one laser source 102, one of skill in the art will appreciate that the laser module 100 may be configured to have two or more lasers, such as a red laser and a green laser, a red laser and an infrared laser, or a green laser and an infrared laser, and these may be selectively actuated depending on the lighting conditions.

As may be seen in FIGS. 1A-1D, in various embodiments, laser module 100 also may include a range knob 104 that may be used to adjust the quadrant and elevation values to suit the ballistic properties of a given munition. For example, in some embodiments, the weight of the projectile and the propellant used may affect the quadrant and elevation values selected, and an A9 round may use different quadrant and elevation values than an A7 round, for example. In various embodiments, one of several different settings may be selected with range knob 104, and in some embodiments, laser module 100 may include a plurality of preset quadrant and elevation factory settings. For example, in one specific, non-limiting example, laser module 100 may include several different factory settings, such as three, four, five six, seven, or even more settings, the range of the device may be between about 50 and about 200 meters, and range knob 104 may be provided with a plurality of detents in predetermined increments, such as 50 or 25 meter increments.

As may be seen in FIGS. 1A-1C, various embodiments of laser module 100 also may include a battery chamber adapted to receive one or more batteries (not shown) and a battery cap 106 adapted to create a water-tight seal and resist the influx of water into the battery chamber. In some embodiments, battery cap 106 may be tethered to laser module 100 to prevent accidental loss. As may be seen in FIGS. 1B-1C, some embodiments of laser module 100 also may include an accessory retention element 108, such as a ring, split ring, clip, carabiner, or the like, for example for securing the device to a pocket, belt loop, or other item when the device is not coupled to a weapon.

Various embodiments also may include one or more base plate gripping features 110, which may be configured to couple to the base plate and that may provide the primary alignment and attachment means for laser module 100 to the base plate (see, e.g., FIGS. 1C and 1D). As may be seen in FIGS. 1C and 1D, in various embodiments, laser module 100 also may include a registration shaft 112 that is coupled to and extends from the underside of range knob 104, and that facilitates registration of the laser shaft to the base plate (not shown). In some embodiments, as range knob 104 is rotated, registration shaft 112 may transmit the rotation to a corresponding cam inside the base plate. In various embodiments, registration shaft 112 and range knob 104 may be spring loaded and may be laterally translatable (e.g., may be pulled away from the base plate) to facilitate loading and removal of laser module 100 from the base plate. In various embodiments, laser module 100 may be removed from the base plate by pulling range knob 104 away from the base plate, which may disengage registration shaft 112 from the corresponding cam in the base plate. In some embodiments, range knob 104 and registration shaft 110 may only be laterally translatable when range knob is in a particular position, such as the 100 meter position. In some embodiments, this may ensure that laser module may only be coupled to or uncoupled from the base plate when range knob is in a predetermined position, such as the 100 meter position, in some examples, thus providing a lockout feature.

FIGS. 2A-2E are five views of a base plate for use in accordance with various embodiments, including a top view (FIG. 2A), a right side view (FIG. 2B), a left side view (FIG. 2C), a left side partial cutaway view (FIG. 2D), and a cross-sectional view (FIG. 2E), in accordance with various embodiments. As described above, in various embodiments, a laser module, such as the laser module 100 illustrated in FIGS. 1A-1D, may be detachably mounted to a rocket launcher via a fixed base plate 200, an example of which is illustrated in FIGS. 2A-2E. In various embodiments, a series of base plates 200 may be coupled to a series of rocket launchers, for example by a permanent coupling mechanism, and after one rocket launcher is fired, the laser module may be detached from the base plate 200 on the spent rocket launcher and coupled to a new base plate 200 on a new rocket launcher. Thus, in various embodiments, the laser module may be removed and reused over and over again, saving money.

Figure 2A:
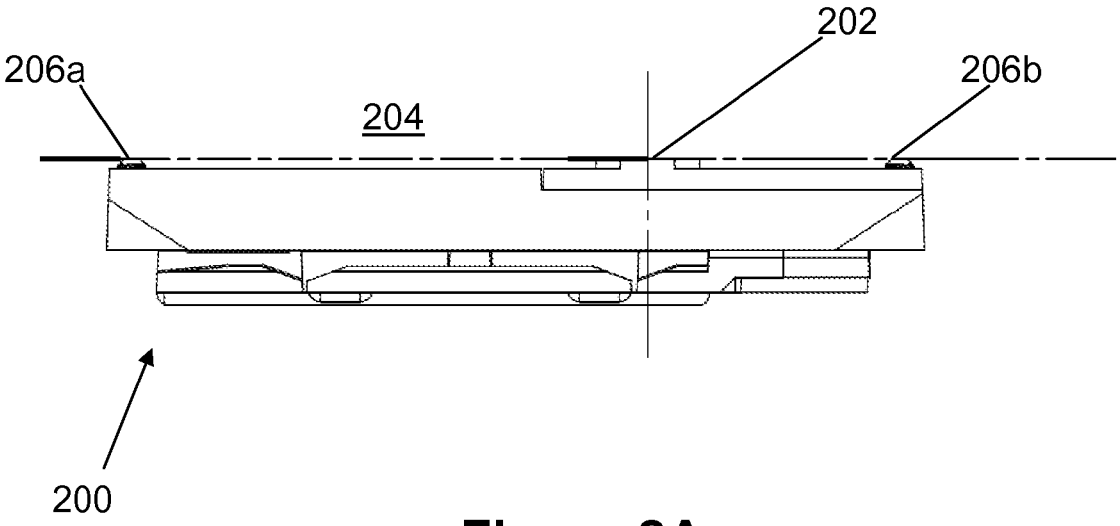
FIGS. 2A-2E are five views of a base plate for use in accordance with various embodiments, including a top view (FIG. 2A), a right side view (FIG. 2B), a left side view (FIG. 2C), a left side partial cutaway view (FIG. 2D), and a cross-sectional view (FIG. 2E), in accordance with various embodiments.

In the embodiment illustrated in FIGS. 2A-2E, the side of base plate 200 that faces the rocket launcher, which in the illustrated embodiment is the left side, may include a raised fulcrum point 202 that comes in direct contact with the rocket launcher body 204 (See, e.g., FIG. 2A). Azimuth adjustment screws 206*a*, 206*b* may also be provided near each end of base plate 200, and may be used to calibrate the azimuth by pivoting base plate 200 on fulcrum 202.

Figure 2B:
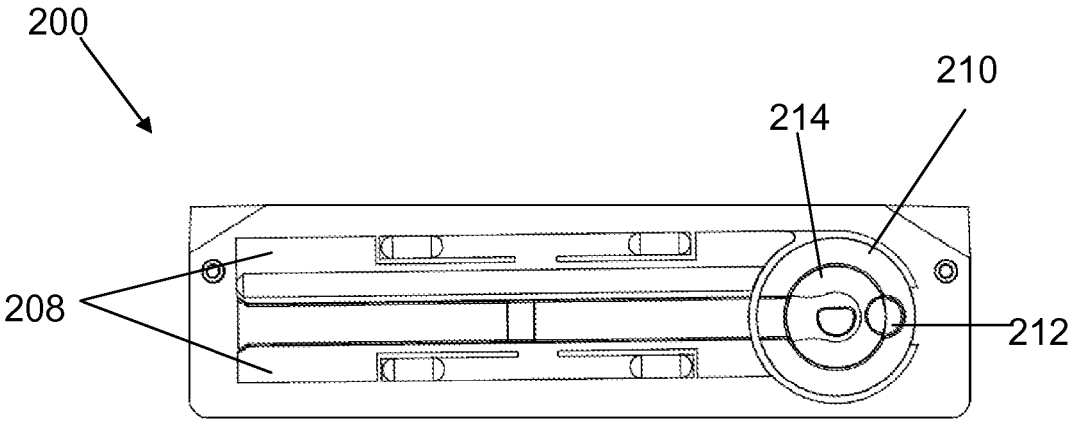

Turning now to FIG. 2B, in various embodiments, the right side of base plate 200 may include one or more rail mounting members 208 that may be configured to couple securely with the base plate gripping features 110 illustrated in FIGS. 1C and 1D. Also visible in this view in FIG. 2B is a rotating docking hub 214, which may serve as the point of engagement for the registration shaft (112, see FIGS. 1C and 1D) coupling laser module 100 with the internal cam (220, see FIG. 2D, discussed below). Also visible in FIG. 2B is an alignment marker 212, which may serve as a visual check to ensure that base plate 200 is in the default load-and-unload position, which in the illustrated example is the 100 meter position. In some embodiments, a portion of alignment marker 212 may be on the rotating docking hub 214, and another portion may be on the stationary hub 210. In various embodiments, the two portions of alignment marker 212 may be aligned when base plate 200 is in the default position.

Figure 2C:
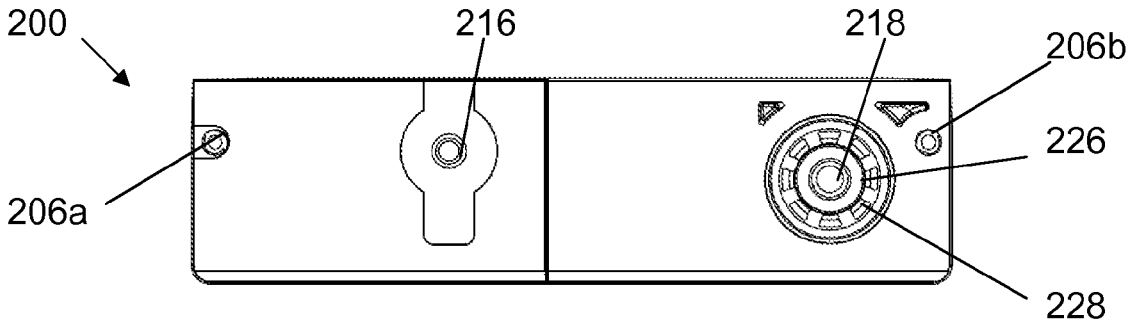

FIG. 2C is a left side view of base plate 200, and shows the side that faces the rocket launcher body 204 when mounted (e.g., see FIG. 2A). In some embodiments, an attachment screw 216 may be visible from the left side, may serve as a point of elevation adjustment (e.g., as fulcrum point 202, see FIG. 2A), and may be received by a corresponding mounting screw hole on the rocket launcher body. In some embodiments, attachment screw 216 may serve as a temporary attachment point during calibration and bonding of the laser sight, as described in greater detail below. For example, in some embodiments, the process of coupling of base plate 200 to rocket launcher body 204 may include a temporary attachment step, and when base plate 200 is temporarily attached to the rocket launcher body by attachment screw 216, attachment screw 216 may serve as a point of rotation for elevation adjustment during the calibration process. Also visible in this view in various embodiments are azimuth adjustment screws 206*a*, 206*b*, and pivot point 218, about which the rail mounting members (208, see FIG. 2B) may pivot during elevation adjustments, as described in greater detail below. In various embodiments, a disk spring 226 and corresponding self locking retaining ring 228 may be provided to create a preload and create tension between pivot point 218 and base plate 200, thus removing any tolerance gaps.

Figure 2D:
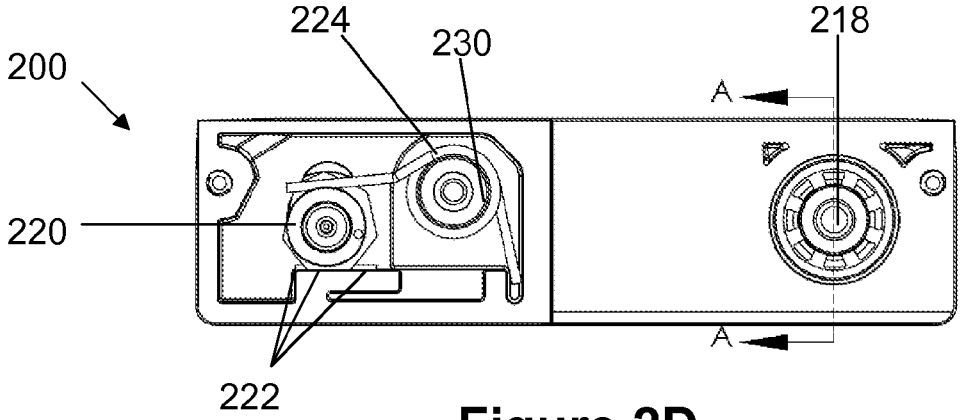

FIG. 2D is a left side, partial cutaway view of base plate 200, wherein the back plate has been removed to show the inner cam mechanism. As described above, when registration shaft 112 on laser module 100 is inserted into rotating docking hub 214, registration shaft 112 engages cam 220. Thus, in various embodiments, as range knob 104 on laser module 100 is rotated, the resulting rotation of registration shaft 112 may drive rotation of cam 220.

In various embodiments, cam 220 may engage cam base 222, which provides a stationary surface for registration of cam 220, and cam 220 may come to rest in one of several flats along cam 220 surface. Each of the flat sides of cam 220 has a different thickness dimension and a different depth dimension, causing the distance to change between the center of cam 220 and cam base 222, and simultaneously causing the distance to change between rail mounting members 218 and base plate 200, thus pivoting rail mounting members 208 about pivot point 218 in vertical and lateral directions to achieve the desired angular elevation. In various embodiments, cam 220 may be held in place against cam base 222 by torsion spring 224, which may have one fixed leg and one dynamic leg configured to interface with a corresponding receiving groove in cam 220, thus providing sufficient force to ensure that cam 220 engages cam base 222. A post torsion spring 230 also may be provided that may provide the axis of rotation and capture torsion spring 224, and that also may be threaded or capture a threaded insert that provides the threads to engage attachment screw 216 (see, e.g., FIG. 2C)

Figure 2E:
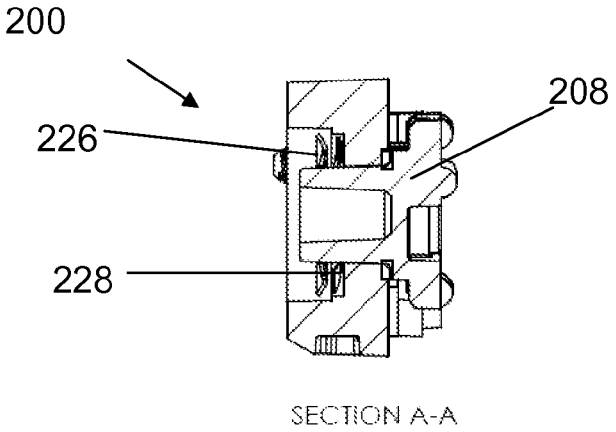

In various embodiments, the correct angular elevation may be derived from the ballistic characteristics of the launcher munition and referred to as the quadrant and elevation angles (Q & E). Although the illustrated cam may be suitable for use with many types of rounds, including A4-A7, A9, E8, E10, and ASM-RC, in various embodiments, different cams may be substituted for the illustrated cam if Q & E values are needed that are not provided by the illustrated embodiment. FIG. 2E is a cross sectional view taken through the line labeled "A" in FIG. 2D, and it shows the spatial relationships of disk spring 226, corresponding self locking retaining ring 228, and rail mounting member 208.

Figure 3A:
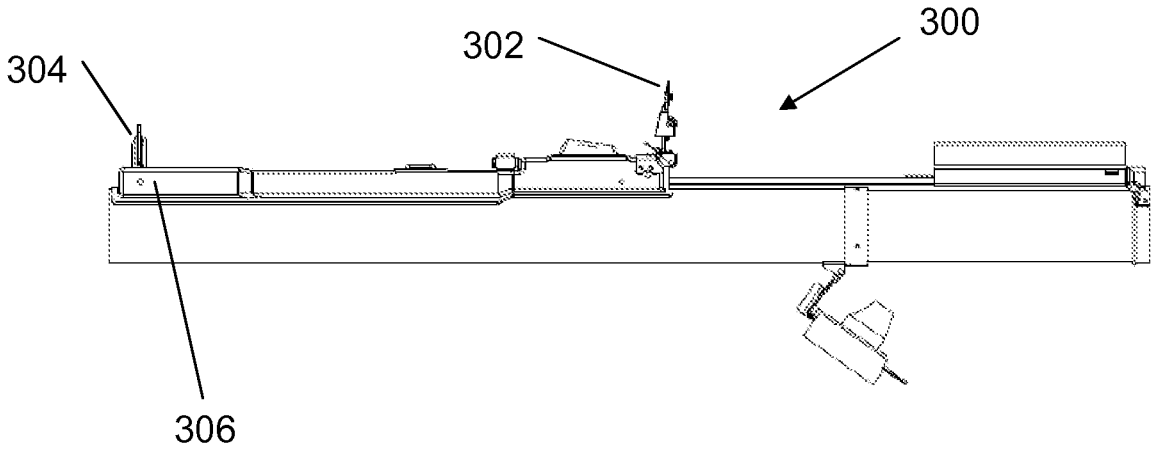
FIGS. 3A-3C illustrate an M72 shoulder fired rocket launcher (FIG. 3A), a close-up side view of a base plate mounted on the rocket launcher of FIG. 3A (FIG. 3B), and a front view of a base plate mounted on the rocket launcher of FIG. 3A (FIG. 3C), in accordance with various embodiments.
Figure 3B:
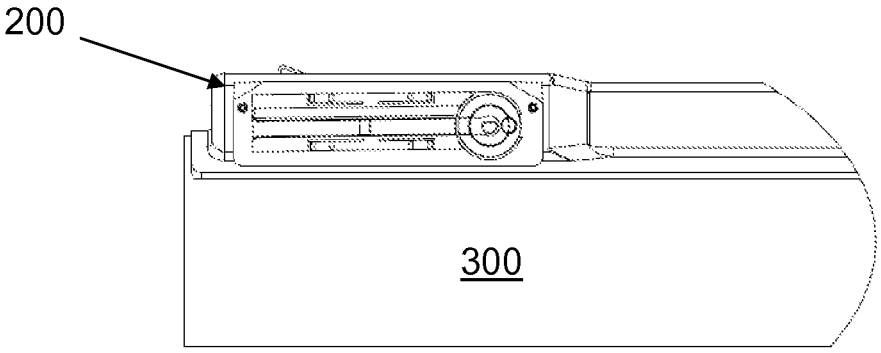
Figure 3C:
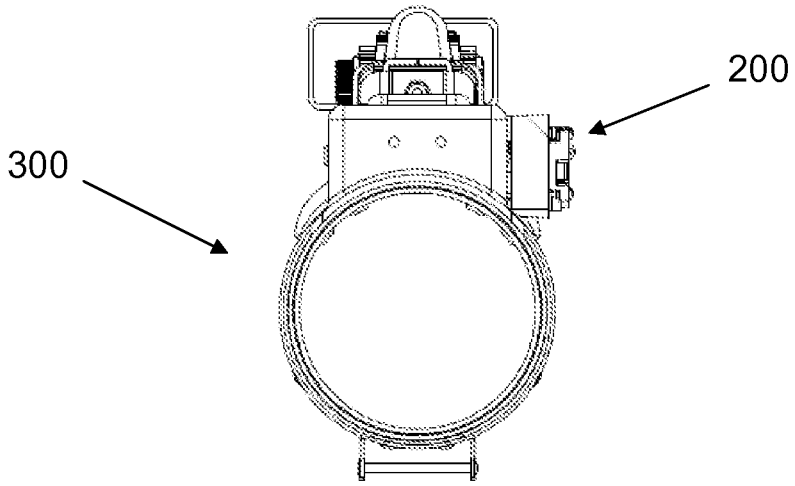

FIG. 3A illustrates an M72 shoulder fired rocket launcher 300 suitable for use with various embodiments. FIG. 3A indicates the location of an iron sight adjustable pop-up alignment sight 302, which requires adjustment to compensate for target distance, a non-adjustable iron sight fixed pop-up alignment sight 304, and a mounting face surface 306 for attachment of a base plate as described herein. FIG. 3B shows a close-up side view of a base plate 200 mounted on the rocket launcher 300 of FIG. 3A, and FIG. 3C show a front view of base plate 200 mounted on rocket launcher 300.

Figure 4A:
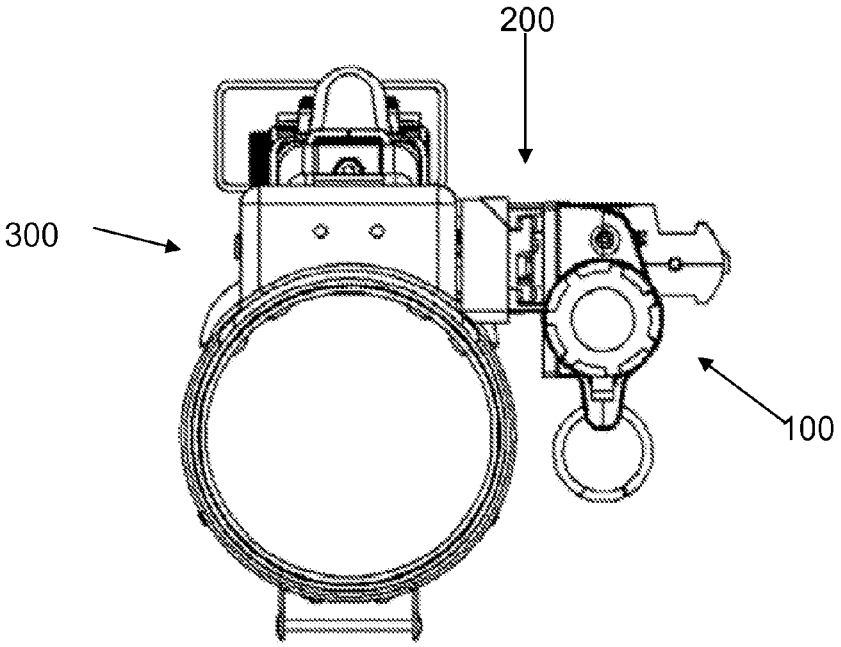
FIGS. 4A and 4B illustrate a front view of a laser module that is coupled to a base plate mounted on an M72 shoulder fired rocket launcher (FIG. 4A), and a cross sectional view of the laser module, base plate, and rocket launcher of FIG. 4A, viewed from above (FIG. 4B), in accordance with various embodiments.
Figure 4B:
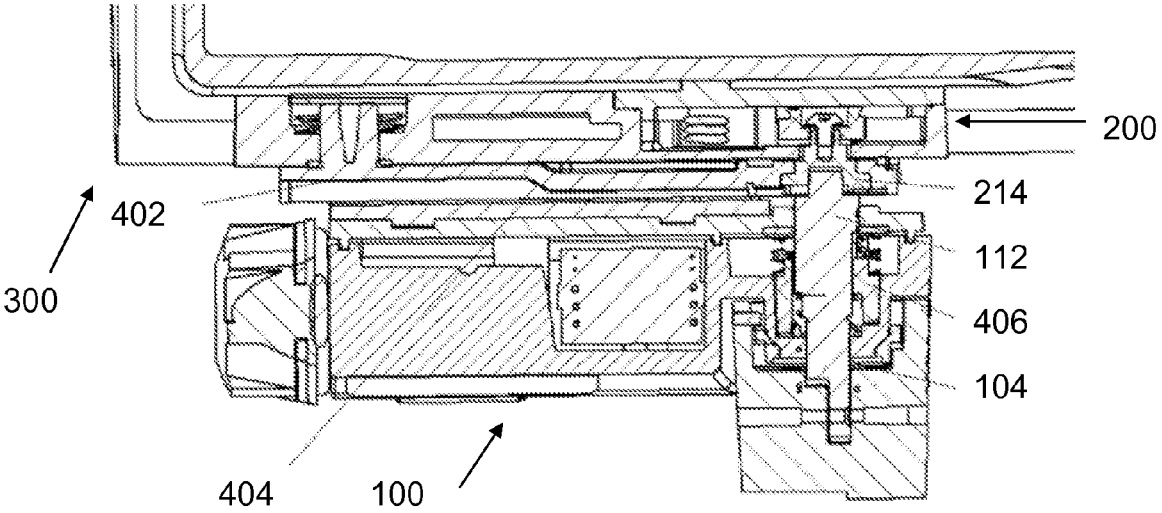

FIG. 4A illustrates a front view of a laser module that is coupled to a base plate mounted on an M72 shoulder fired rocket launcher, and shows the spatial relationships between the base plate 200, laser module 100, and rocket launcher 300. FIG. 4B is a cross sectional view of the laser module 100, base plate 200, and rocket launcher 300 of FIG. 4A, viewed from above, and illustrates a number of small details that add to the functionality of the laser sight. In particular, a first ramp 402, which is a feature of the rail mounting members, provides a ramp that, during docking of laser module 110 to base plate 200, may push spring-loaded registration shaft 112 up, allowing it to drop into rotating docking hub 214. Also illustrated is a second ramp 404 that, during docking, may push registration shaft 112 up as a result of sliding laser module 100 onto base plate 200. Also illustrated in FIG. 4B is a detent mechanism 406 internal to laser module 100 that includes a spring loaded hub that travels on spines on the laser shaft and drops into pockets in seven locations in various embodiments. In some embodiments, detent mechanism 406 may provide a tactical feed back to the user to indicate that the range knob 104 has rotated to the next position. In some embodiments, precise indexing b]may be accomplished with only with the cam. Additionally, some embodiments include rotational travel stops for range knob 104 that prevent free running of range knob 104 once the limits have been reached, for instance at the 50 meter or 200 meter settings, at which points the knob rotation must be reversed, allowing the user to identify the range knob setting in total darkness by counting down or up in increments of 25 meters (or 50 meters in other embodiments) from each travel stop.

In various embodiments, in use, a base plate may be fixed or coupled to a rocket launcher using the following method. First, a hole is drilled in the rocket launcher housing in a location suitable for mounting the base plate, adhesive is applied to the back of the range plate, a screw is inserted through the hole and threaded into the base plate threaded insert and tightened to temporarily secure the base plate to the rocket launcher. A master laser is then slid onto the base plate to facilitate calibration, and the master laser is aimed at a calibration target using the pivot point of the screw to achieve correct elevation, and the two azimuth adjustment screws are adjusted to achieve azimuth calibration.

Once the calibration point is achieved, an ultraviolet (UV) curable adhesive is applied between the base plate and the rocket launcher to tack the base plate in place and facilitate removal of the master laser. The position of the base plate may then be locked when the adhesive is cured.

Once the base plate has been fixed to the rocket launcher, the laser module may then be installed onto the base plate. In various embodiments, the user may first align the base plate gripping features on the laser module to the rail mounting members, and them may slide the base plate gripping features onto the rail mounting members until the registration shaft engages the rotating docking hub, stopping the installation motion and locking the laser module to the base plate.

Removal of the laser module from the base plate involves first returning the range knob to the 100M position, and then pulling on the range knob to disengage the registration shaft from the rotating docking hub and slipping the laser module from the base plate.

In various embodiments, the laser device may meet the requirements of MIL-STD-810G, and may be waterproof, shock resistant, and may offer repeatable accuracy. In particular embodiments, the device may weigh only 3-4 ounces, for instance about 3.5 oz, adding almost nothing to the user's burden, while making tasks such as explosive building entry or the destruction of enemy fortifications much easier.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

We claim:

1. A reusable laser sight for a rocket launcher comprising: a base plate configured to be permanently mounted on a rocket launcher; a laser module configured to removably couple to the base plate, wherein the laser module comprises a laser source, a range knob configured to adjust range setting, and a base plate gripping feature configured to detachably couple to the base plate; wherein the base plate comprises a rail mounting member, and wherein the base plate gripping feature is configured to detachably couple to the rail mounting member; wherein the base plate further comprises a docking hub, and wherein the laser module comprises a registration shaft coupled to and extending from the range knob, wherein the registration shaft is configured to removably engage with the docking hub; wherein the registration shaft is configured to be laterally translatable, and wherein the registration shaft is configured to disengage from the docking hub when the range knob is pulled.

2. The reusable laser sight of claim 1, wherein the docking hub comprises a rotatable cam, and wherein rotation of the range knob causes the registration shaft to rotate the cam.

3. The reusable laser sight of claim 2, wherein the cam is configured to adjust both quadrant and elevation of the rail mounting member when the cam is rotated.

4. The reusable laser sight of claim 3, wherein adjusting range setting comprises adjusting quadrant and elevation values.

5. The reusable laser sight of claim 3, wherein the laser sight is configured to be adjustable for a range between 50 meters and 200 meters.

6. The reusable laser sight of claim 5, wherein the laser sight comprises preset quadrant and elevation settings for a plurality of corresponding preset range values.

7. The reusable laser sight of claim 6, wherein the range knob is provided with a plurality of rotational detents, and wherein each rotational detent corresponds to a different preset range value.

8. The reusable laser sight of claim 1, wherein the base plate comprises fulcrum adapted to contact an outside surface of the rocket launcher, and an azimuth adjustment screw configured to adjust azimuth of the base plate relative to a longitudinal axis of the rocket launcher.

9. The reusable laser sight of claim 1, wherein the laser source comprises a red or green laser diode.

10. The reusable laser sight of claim 1, wherein the laser source comprises an infrared diode.

11. The reusable laser sight of claim 1, wherein the registration shaft is configured to engage with or disengage from the docking hub only when the range knob is oriented in a predetermined rotational position.

12. The reusable laser sight of claim 1, wherein the cam comprises a cam perimeter, and wherein the cam perimeter comprises a plurality of flat surfaces, each flat surface corresponding to a different range setting.

13. The reusable laser sight of claim 12, wherein each flat surface of the cam perimeter is configured to engage a cam base.

14. The reusable laser sight of claim 13, wherein each flat surface of the cam perimeter is configured to position a central rotational axis of the cam a different distance from the cam base.

15. The reusable laser sight of claim 1, wherein the laser module is configured to couple to and uncouple from the base plate repeatedly without requiring windage and elevation adjustments or bore alignments.

16. The reusable laser sight of claim 1, wherein the rocket launcher is a Nammo Tally M72 LAW, an MGM-1 Matador rocket launcher, an FGM-148 Javelin rocket launcher, or a Carl-Gustaf M2GC recoilless rocket.

* * * * *